US006932596B2

(12) United States Patent
Watanabe

(10) Patent No.: US 6,932,596 B2
(45) Date of Patent: Aug. 23, 2005

(54) BLOWTORCH

(75) Inventor: Motoyasu Watanabe, Taichung Hsien (TW)

(73) Assignee: Arlo Lin, Tortola (VG)

( * ) Notice: Subject to any disclaimer, the term of this patent is extended or adjusted under 35 U.S.C. 154(b) by 98 days.

(21) Appl. No.: 10/721,591

(22) Filed: Nov. 24, 2003

(65) Prior Publication Data

US 2005/0112518 A1 May 26, 2005

(51) Int. Cl.[7] ..... F23D 11/36

(52) U.S. Cl. ..... 431/153

(58) Field of Search ..... 431/153

(56) References Cited

U.S. PATENT DOCUMENTS 6,196,833 B1 * 3/2001 Ho ..... 431/153
6,293,782 B1 * 9/2001 Tsai ..... 431/153
6,527,543 B2 * 3/2003 Tsai ..... 431/153
6,688,879 B2 * 2/2004 Tsai ..... 431/153

* cited by examiner

*Primary Examiner*—Alfred Basichas
(74) *Attorney, Agent, or Firm*—Alan D. Kamrath; Nikolai & Mersereau, P.A.

(57) ABSTRACT

A blowtorch includes a reservoir for storing gas, a valve for controlling the flow of the gas from the reservoir, a nozzle for spraying the gas from the valve, an igniter for igniting the gas sprayed from the nozzle, a handle device for controlling the valve and the igniter and a security device for keeping the handle device in check.

15 Claims, 8 Drawing Sheets

BLOWTORCH

FIELD OF THE INVENTION

The present invention relates to a blowtorch.

BACKGROUND OF INVENTION

Referring to FIG. 11, a conventional blowtorch 90 includes a reservoir 91 for storing gas, a valve 92 for controlling the flow rate of the gas from the reservoir 91, a nozzle 93 for spraying the gas from the valve 92 and an igniter 94 for igniting the gas sprayed from the nozzle 93. The valve 92 includes a knob 95 operable in order to adjust the flow rate of the gas through the valve 92. The igniter 94 includes a button 96 operable so as to actuate the igniter 94 to produce a spark in order to ignite the gas sprayed from the nozzle 93. When not using the blowtorch 90, a user is required to shut down the valve 92. However, it is difficult to shut down the valve 92 completely. Leakage of the gas from the reservoir 91 is therefore inevitable. Sometimes, the user even forgets to shut down the valve 92. In both cases, the user may push the button 96 by accident, and this could incur a disaster.

The present invention is therefore intended to obviate or at least alleviate the problems encountered in prior art.

SUMMARY OF THE INVENTION

It is the primary objective of the present invention to provide a blowtorch with a secure valve.

According to the present invention, a blowtorch includes a reservoir for storing gas, a valve for controlling the flow of the gas from the reservoir, a nozzle for spraying the gas from the valve, an igniter for igniting the gas sprayed from the nozzle, a handle device for controlling the valve and the igniter and a security device for keeping the handle device in check.

Other objects, advantages and novel features of the invention will become more apparent from the following detailed description in conjunction with the drawings.

BRIEF DESCRIPTION OF DRAWINGS

The present invention will be described via detailed illustration of the preferred embodiment referring to the drawings.

DETAILED DESCRIPTION OF PREFERRED EMBODIMENT

Figure 1:
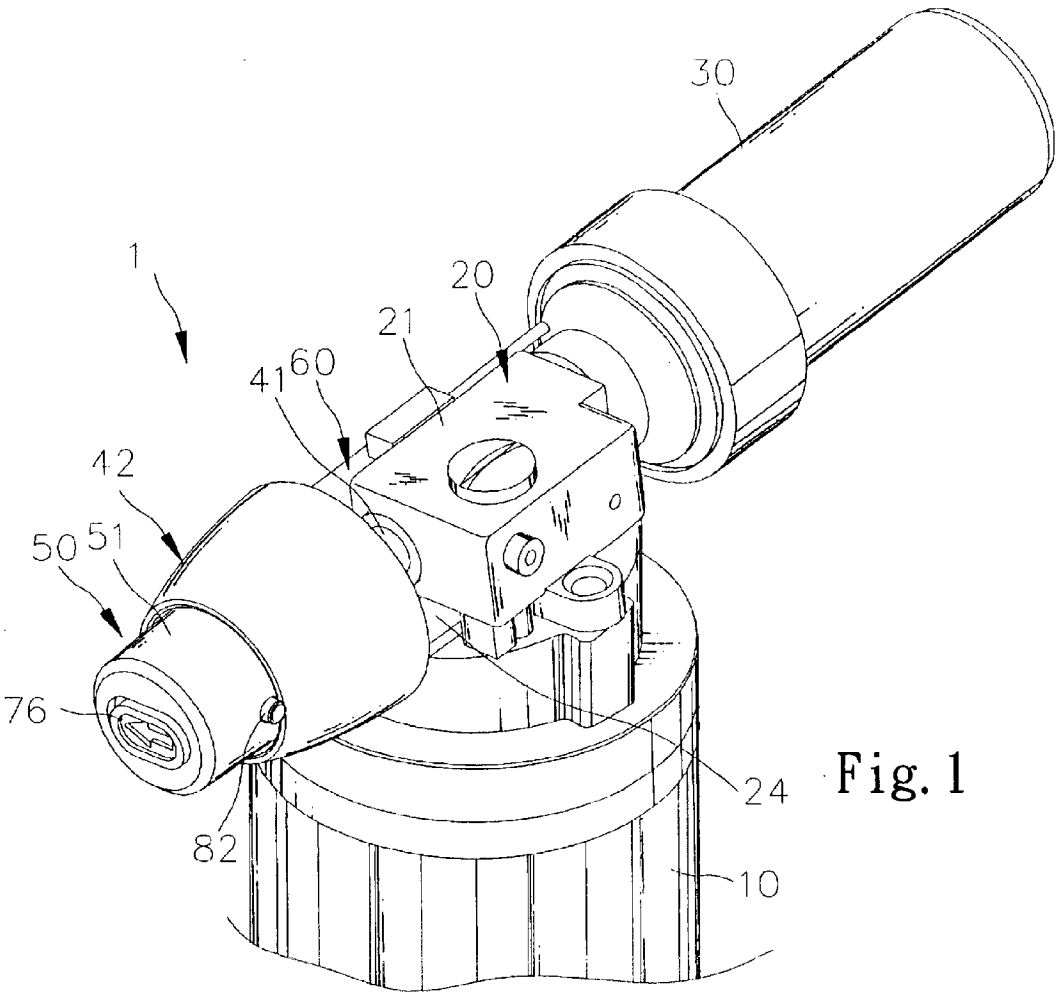
FIG. 1 is a perspective view of a blowtorch including a reservoir, a valve, a nozzle, an igniter and a handle device according to the preferred embodiment of the present invention.
Figure 2:
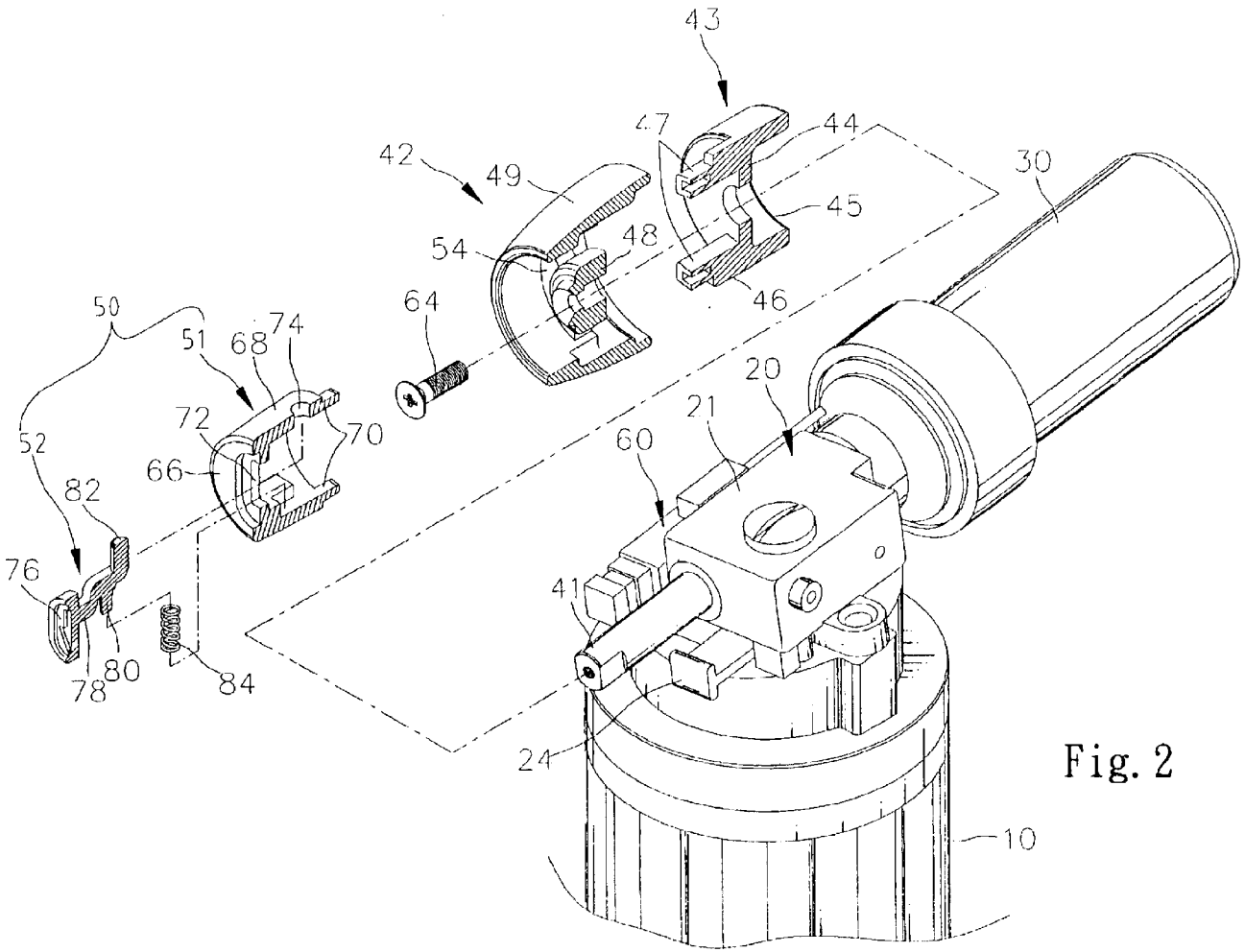
FIG. 2 is an exploded view of the handle device of the blowtorch of FIG. 1.
Figure 3:
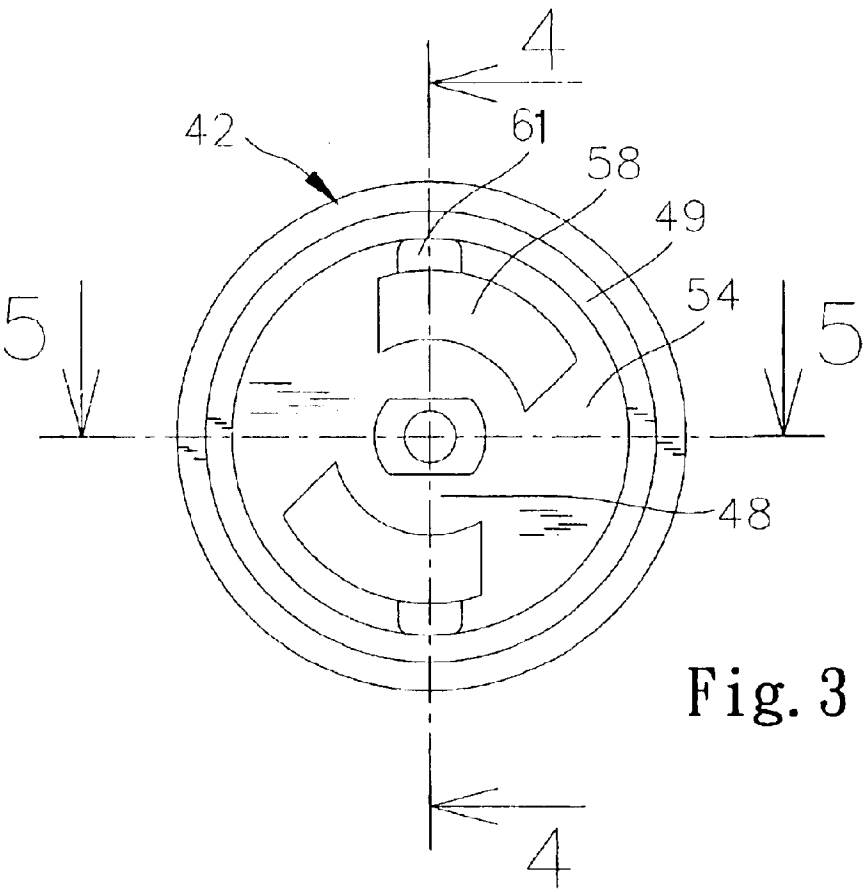
FIG. 3 is a rear view of a knob of the handle device of FIG. 2.
Figure 4:
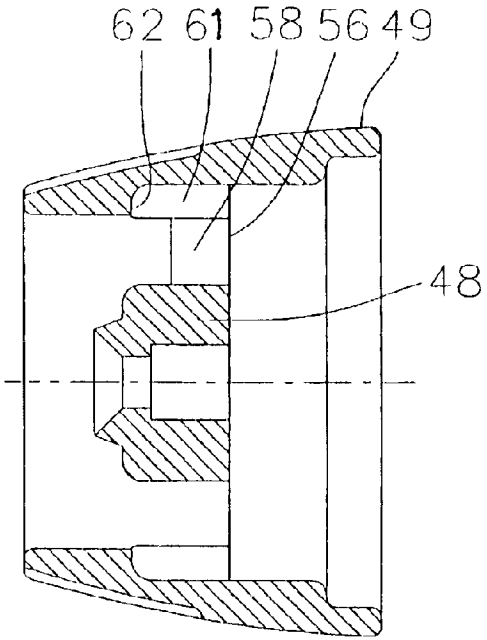
FIG. 4 is a cross-sectional view taken along a line 4—4 in FIG. 3.
Figure 5:
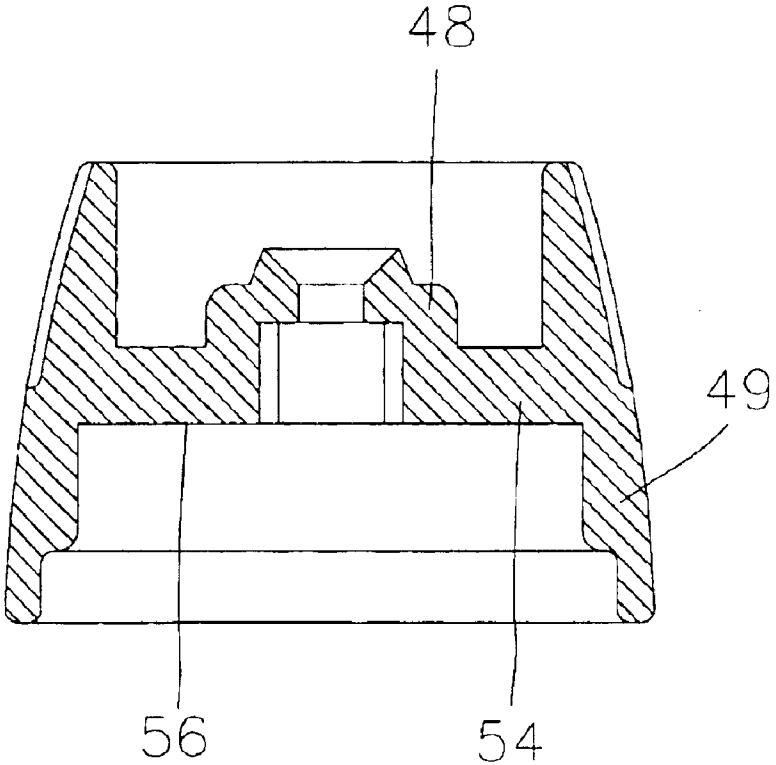
FIG. 5 is a cross-sectional view taken along a line 5—5 in FIG. 3.

Referring to FIGS. 1 and 2, a blowtorch 1 according to the preferred embodiment of the present invention is shown. The blowtorch 1 includes a reservoir 10 for storing gas, a valve 20 for controlling the flow of the gas from the reservoir 10, a nozzle 30 for spraying the gas from the valve 20, an igniter 60 for igniting the gas sprayed from the nozzle 30, a handle device 40 for controlling the valve 20 and the igniter 60 and a security device 50 for keeping the handle device 40 in check.

The reservoir 10, the nozzle 30 and the igniter 60 will not be described in detail for being conventional.

The valve 20 includes a housing 21 through which the reservoir 10 is communicated with the nozzle 30. The valve 20 further includes a switching device and an adjusting device. The switching device includes a pusher 24 extending from the housing 21. The pusher 24 can be moved so as to switch the valve 20 between a communicating mode and a blocking mode. The adjusting device includes a driver 41 extending from the housing 21. The driver 41 can be rotated so as to adjust the flow rate of the gas through the valve 20. The valve 20 will not be described in detail for not being the spirit of the present invention.

The handle device 40 is provided for driving the pusher 24, the driver 41 and the igniter 60. The handle device 40 includes an internal button 43 for pushing the pusher 24 and the igniter 60. Furthermore, the handle device 40 includes a knob 42 for driving the driver 41.

The internal button 43 includes a ring 44, a cylinder 45 extending from a side of the ring 44, two rods 46 extending from an opposite side of the ring 44 and two tubes 47 each extending from corresponding one of the rods 46. The rods 46 are wide compared with the tubes 47 so that a portion of the free end of each rod 46 is exposed from the corresponding tube 47.

Figure 7:
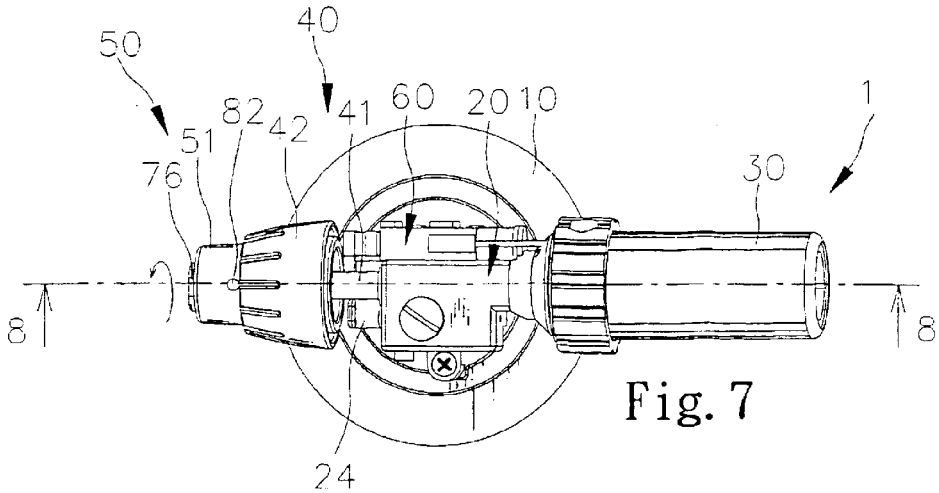
FIG. 7 is a top view of the blowtorch of FIG. 6.

In assembly, the internal button 43 is put around the driver 41. With reference to FIG. 7, the cylinder 49 is in contact with the pusher 24 and the igniter 40.

Referring to FIGS. 2–5, the knob 42 includes a hub 48, a cylinder 49 and a ring 54 formed between the hub 48 and the cylinder 49. The hub 48 includes an internal side compliant with the profile of the free end of the driver 41. Thus, the hub 48 cannot be rotated around the end of the driver 41 when the hub 48 is put around the end of the driver 41. The ring 54 includes a rear face 56 for contact with the rods 46. Two slots 58 are defined in the ring 54. Two recesses 61 are cut into the rear face 56 of the ring 54. Each of the recesses 61 is communicated with corresponding one of the slots 58. Each of the recesses 61 includes a rear face 62 for contact with the free end of corresponding one of the rods 46.

In assembly, the hub 48 is put around the driver 41. The rods 46 are put in the recesses 61. The ends of the rods 46 abut the rear faces 62 of the recesses 61. The tubes 47 extend beyond the slots 58. A screw 64 is driven into the driver 41 through the collar 48 and the ring 44. Thus, the knob 42 and the internal button 43 are secured to the driver 41.

The security device 50 includes an external button 51 connected with the internal button 43 in the knob 42 and a lock 52 for locking the external button 51 to the knob 42.

The external button 51 includes a disc 66, a cylinder 68 extending from the disc 66 and two inserts 70 extending from the cylinder 68. The disc 66 defines a slot 72. The cylinder 68 defines an aperture 74.

The lock 52 includes a head 76. A n indication such as an arrowhead is marked, formed or cut in a side of the head. The indication is used to indicate the flow rate of the gas through the valve 20. A body 78 extends from an opposite side of the head 76. Furthermore, the lock 52 includes a stem 80 extending from a side of the body 78 and a latch 82 extending from an opposite side of the body 78.

In assembly, the stem 80 and the latch 82 are inserted through the slot 72. The latch 82 is inserted through the aperture 74. A spring 84 is put around the stem 80. The spring 84 is compressed between the body 78 and an internal side of the cylinder 68. The cylinder 68 of the external button 51 is put in the cylinder 49 of the knob 42. The inserts 70 of the external button 51 are inserted into the tubes 47 of the internal button 43.

Figure 6:
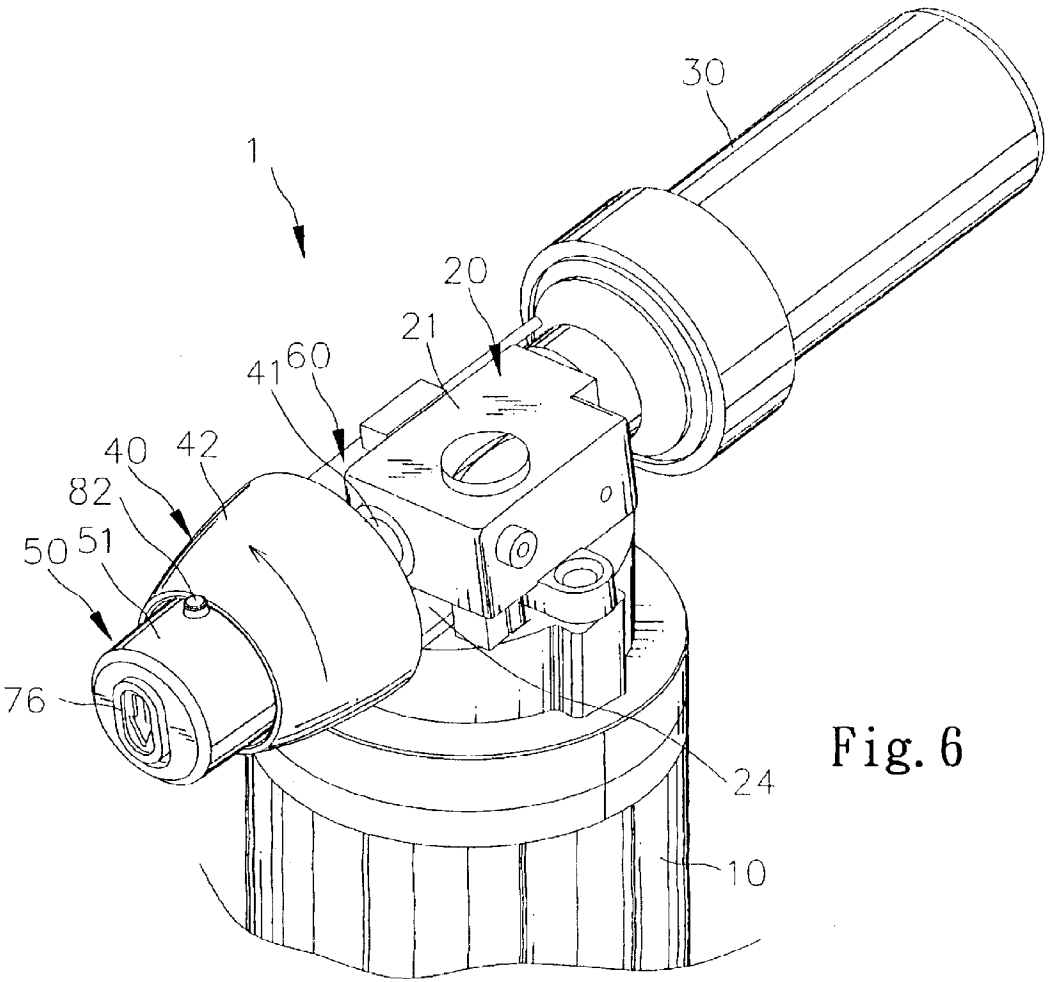
FIG. 6 is similar to FIG. 1 but shows the handle device in another position.
Figure 8:
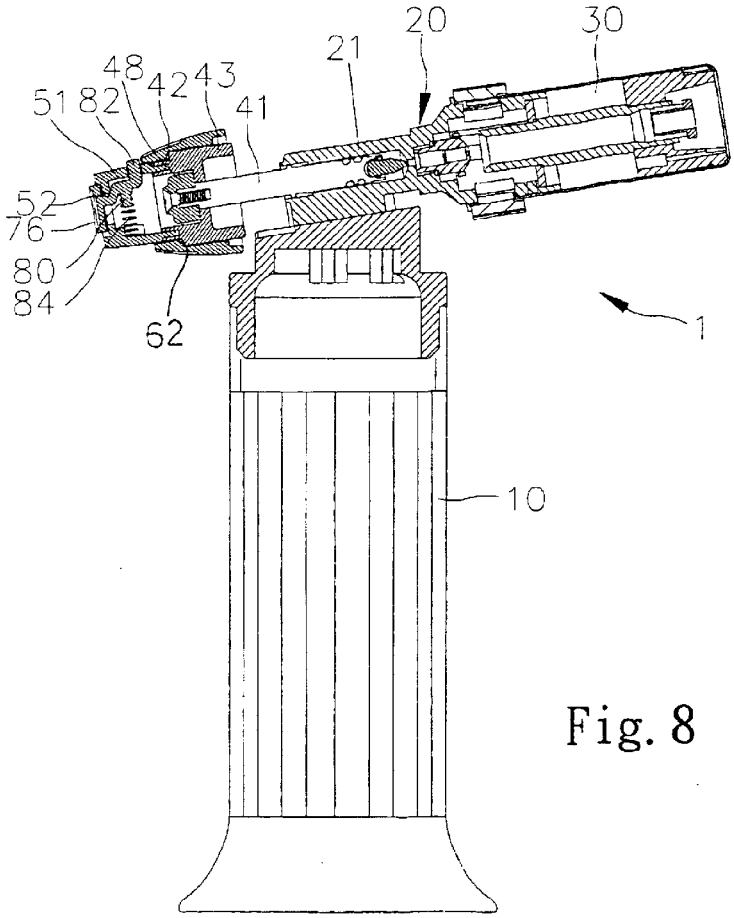
FIG. 8 is a cross-sectional view taken along a line 8—8 in FIG. 7.

Referring to FIGS. 6–8, biased by means of the spring 84, the latch 82 extends from the aperture 74. The latch 82 abuts the knob 42 so as to prevent the movement of the external button 51 relative to the knob 42. The internal button 43 cannot be pushed by means of the external button 51. The pusher 24 and the igniter 40 cannot be pushed by means of the internal button 43. Therefore, the valve 20 cannot be moved to the communicating mode. However, the knob 42 can be rotated in order to drive the driver 41.

Figure 9:
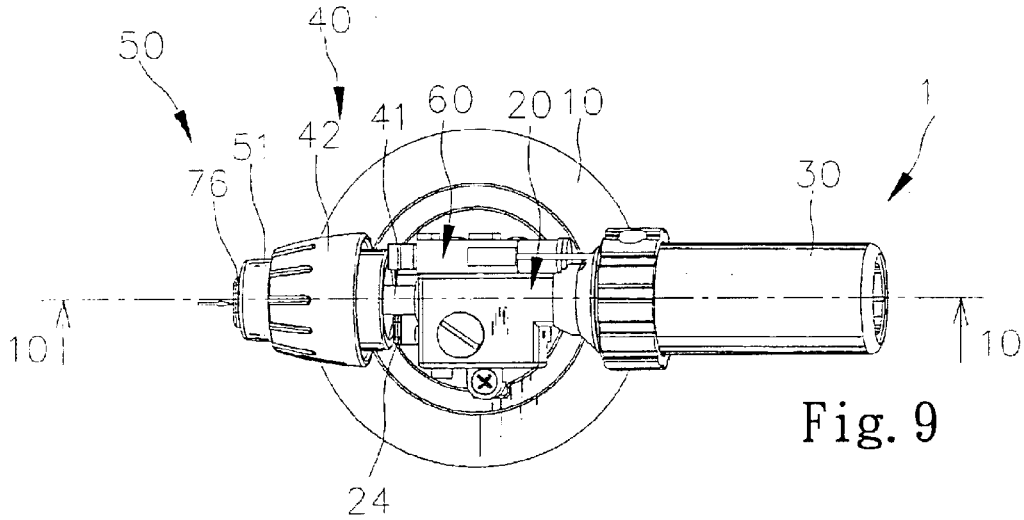
FIG. 9 is similar to FIG. 6 but shows the handle device in another position.
Figure 10:
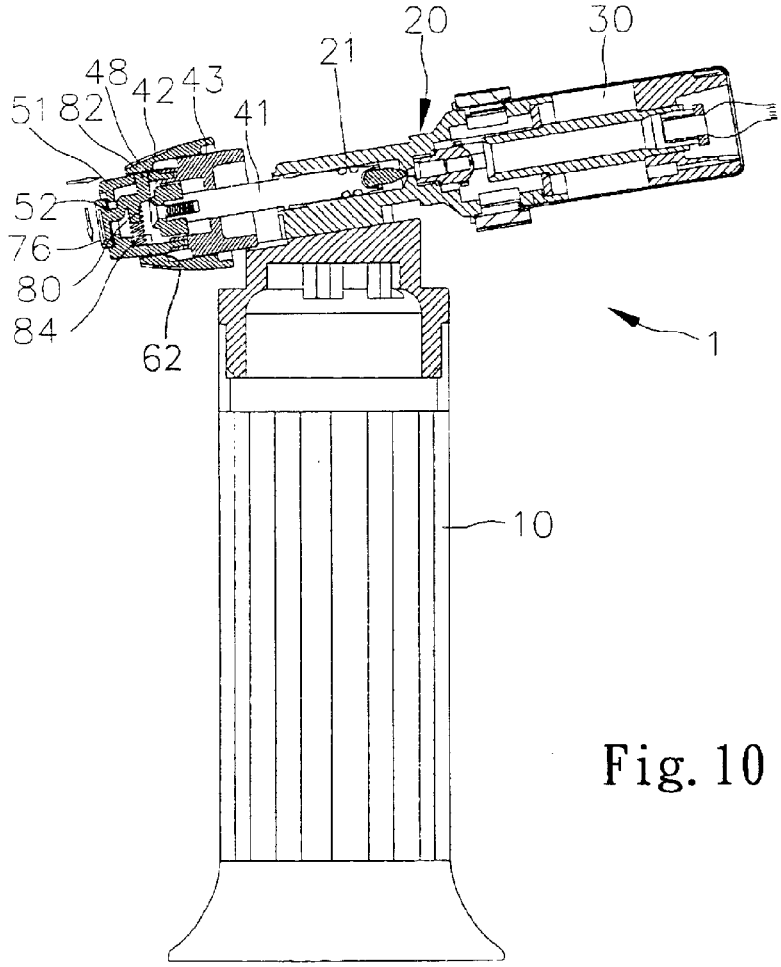
FIG. 10 is a cross-sectional view taken along a line 10—10 in FIG. 9.
Figure 11:
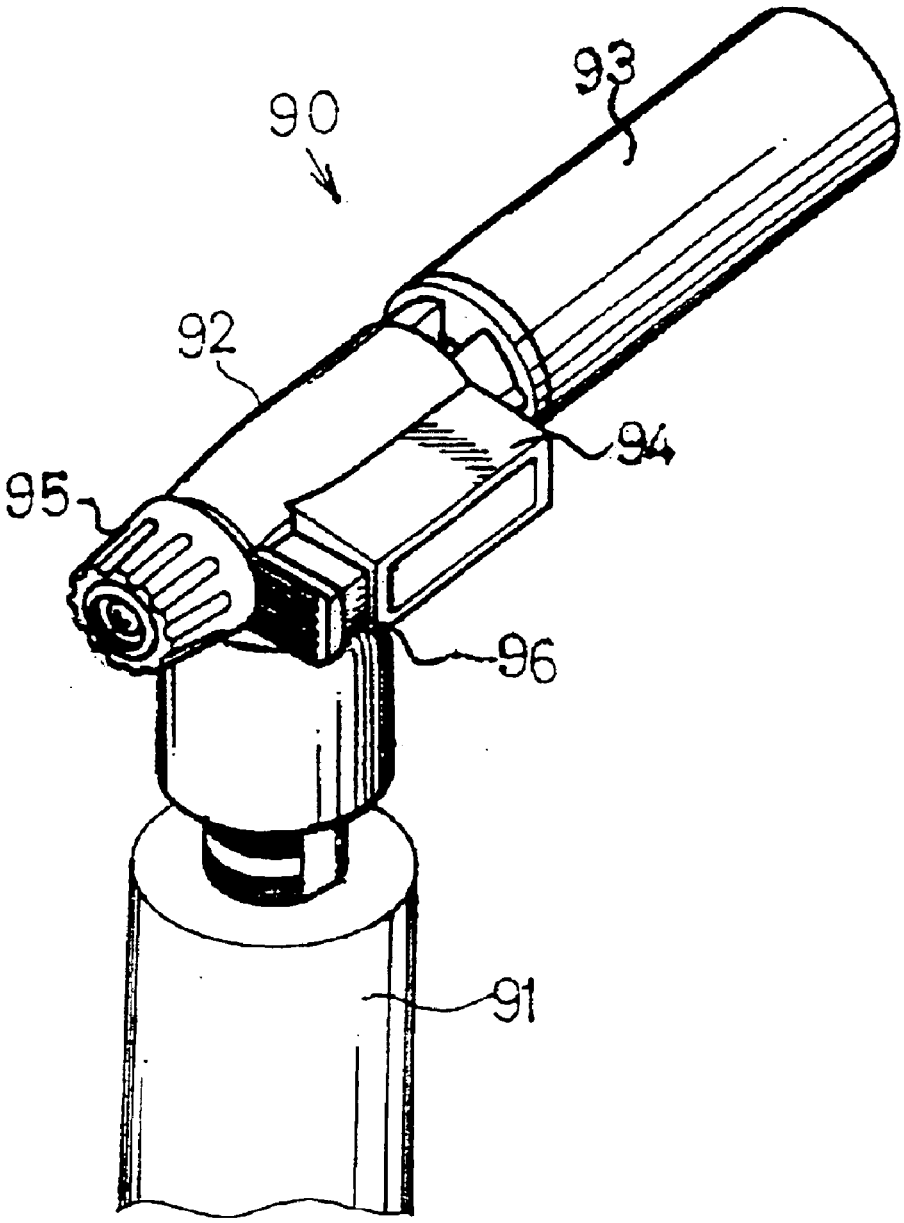
Fig. 11 PRIOR ART
FIG. 11 is a perspective view of a conventional blowtorch.

Referring to FIGS. 9 and 10, the latch 82 is pushed into the aperture 74 in order to allow the movement of the external button 51 relative to the knob 42. The internal button 43 can be pushed by means of the external button 51. The pusher 24 and the igniter 40 can be pushed by means of the internal button 43 . Therefore, the valve 20 can be moved to the communicating mode.

Once the external button 51 is pushed relative to the knob 42, the tips of the rods 46 are moved from the rear faces 62 of the recesses 61. When the external button 51 is pushed to the limit, the rods 46 are completely moved from the recesses 61. Thus, the internal button 43 and the external button 51 are rotated relative to the knob 42 as the tubes 47 that receive the inserts 70 are moved in the slots 58. When the rods 46 are not aligned with the recesses 61, the external button 51 is released. The internal button 43 is released accordingly. The tips of the rods 46 abut the rear face 56 of the ring 44. The internal button 43 is retained in the pressed position. Therefore, the valve 20 is retained in the communicating mode.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A blowtorch comprising a reservoir for storing gas, a valve for controlling the flow of the gas from the reservoir, a nozzle for spraying the gas from the valve, an igniter for igniting the gas sprayed from the nozzle, a handle device for controlling the valve and the igniter and a security device for keeping the handle device in check, wherein the valve includes a driver that can be rotated in order to adjust the flow rate of the gas through the valve, wherein the handle device includes an internal button in contact with the igniter and a knob connected with the driver, and further including a housing through which the reservoir is communicated with the nozzle; and a pusher that extends from the housing and is operable so as to switch the valve between a communicating mode and a blocking mode, with the internal button in contact with the pusher, and with the driver extending from the housing.

2. The blowtorch according to claim 1 wherein the internal button is movable in the knob.

3. The blowtorch according to claim 2 wherein the security device includes an external button connected with the internal button in the knob and a lock for locking the external button to the knob.

4. The blowtorch according to claim 3 wherein lock is installed substantially in the external knob.

5. The blowtorch according to claim 4 wherein the external button includes a cylinder defining an aperture, and the lock includes a latch extending through the aperture for abutment against the knob.

6. The blowtorch according to claim 5 wherein the security device further includes a spring compressed between the cylinder and the latch.

7. The blowtorch according to claim 6 wherein the lock further includes a stem extending into the spring.

8. The blowtorch according to claim 7 wherein the lock further includes a body from which the latch and the stem extend in opposite directions.

9. The blowtorch according to claim 8 wherein the external button includes a disc from which the cylinder extends and a slot defined in the disc, and the body extends through the slot.

10. The blowtorch according to claim 9 wherein the lock includes a head from which the body extends.

11. The blowtorch according to claim 10 wherein the head is provided with an indication.

12. The blowtorch according to claim 3 wherein the internal button includes two tubes extending from a side thereof, and the external button includes two inserts extending from a side thereof into the tubes.

13. The blowtorch according to claim 12 wherein the knob includes a hub in which the driver is fit, a cylinder in which the internal button and the external button are movable, a ring formed between the hub and the cylinder thereof and two slots through the tubes extend.

14. The blowtorch according to claim 2 further includes a retaining device for retaining the internal button in a pressed position in the knob.

15. The blowtorch according to claim 13 wherein the retaining device includes two rods extending from the internal button, an annular shoulder formed on an internal side of the knob and two recesses cut into the annular shoulder, and the rods are put in the recesses in a non-pressed position and put against the annular shoulder in the pressed position.

* * * * *